US008882307B2

(12) United States Patent
Takatori

(10) Patent No.: US 8,882,307 B2
(45) Date of Patent: Nov. 11, 2014

(54) LIGHT EMITTING DEVICE AND ILLUMINATION DEVICE

(75) Inventor: Hiroshi Takatori, Saitama (JP)

(73) Assignee: Enplas Corporation, Kawaguchi (JP)

( * ) Notice: Subject to any disclaimer, the term of this patent is extended or adjusted under 35 U.S.C. 154(b) by 250 days.

(21) Appl. No.: 13/328,654

(22) Filed: Dec. 16, 2011

(65) Prior Publication Data

US 2012/0155091 A1 Jun. 21, 2012

(30) Foreign Application Priority Data

Dec. 20, 2010 (JP) ..... 2010-283134

(51) Int. Cl.

| | |
|---|---|
| ***F21V 5/00*** | (2006.01) |
| ***F21V 5/04*** | (2006.01) |
| *F21Y 101/02* | (2006.01) |
| *F21Y 103/00* | (2006.01) |
| *F21S 4/00* | (2006.01) |

(52) U.S. Cl.

CPC ..... *F21V 5/008* (2013.01); *F21Y 2101/02* (2013.01); *F21Y 2103/003* (2013.01); *F21V 5/04* (2013.01); *F21S 4/008* (2013.01); *Y10S 362/80* (2013.01)

USPC ..... 362/330; 362/311.02; 362/800

(58) Field of Classification Search

USPC ..... 362/249.02, 311.01–311.02, 326, 362/330–332, 608–610, 621, 800

See application file for complete search history.

(56) References Cited

U.S. PATENT DOCUMENTS

| | | | | |
|---|---|---|---|---|
| 2002/0034081 | A1* | 3/2002 | Serizawa | 362/540 |
| 2005/0024845 | A1 | 2/2005 | Mori et al. | |
| 2006/0181901 | A1 | 8/2006 | Sakai et al. | |
| 2008/0198604 | A1 | 8/2008 | Kim et al. | |
| 2011/0096544 | A1 | 4/2011 | Nakamura | |

FOREIGN PATENT DOCUMENTS

| | | | |
|---|---|---|---|
| JP | S62-104311 | A | 7/1987 |
| JP | 2005-050727 | A | 2/2005 |
| JP | 2007-005218 | A | 1/2007 |
| JP | 2009-289506 | A | 12/2009 |
| WO | 2004-111532 | A1 | 12/2004 |
| WO | 2010-001604 | A | 1/2010 |
| WO | 2010-010494 | A1 | 1/2010 |

* cited by examiner

*Primary Examiner* — Jason Moon Han
(74) *Attorney, Agent, or Firm* — Washida IP Group, LLC

(57) ABSTRACT

A light emitting device that can reduce the illuminance unevenness on an illuminated surface. First light flux controlling member 103 controls the distribution of light emitted from light emitting element 102. Second light flux controlling member 105 has second incidence surface 201 onto which the light emitted from first light flux controlling member 103 is incident and second emission surface 202 that is located on a side opposite to second incidence surface 201 and emits the light incident from second incidence surface 201. Also, at least one surface of second incidence surface 201 and second emission surface 202 refracts the light having an optical path on a virtual cross-section including optical axis P1 of light emitting element 102 and being incident onto second incidence surface 201 or second emission surface 202 more to the optical axis P1 side than when being incident onto a plane perpendicular to optical axis P1.

7 Claims, 19 Drawing Sheets

LIGHT EMITTING DEVICE AND ILLUMINATION DEVICE

CROSS REFERENCE TO RELATED APPLICATIONS

This application is entitled and claims the benefit of Japanese Patent Application No. 2010-283134, filed on Dec. 20, 2010, the disclosure of which including the specification, drawings and abstract is incorporated herein by reference in its entirety.

TECHNICAL FIELD

The present invention relates to a light emitting device that illuminates a surface to be illuminated particularly by controlling the distribution of light emitted from a light source, as well as to an illumination device.

BACKGROUND ART

From the past, a light emitting device for spot illumination that illuminates a specific region by radiating light in a specific direction is used for usage such as auxiliary illumination, ceiling illumination, or illumination for a showcase. Further, in recent years, a light emitting diode (LED) is used as a light source of a light emitting device for spot illumination.

The light emitting diode has characteristic features such as having a small scale and emitting light of a vivid color with a good electric power efficiency, having no fear of filament breakage in a bulb because of being a semiconductor element, being excellent in initial driving characteristics, and being strong against vibration or repetition of on-off energization.

A plane light source device (illumination device) for a display device having such a light emitting diode as a light source is known (for example, Patent Literature 1). Patent Literature 1 discloses an illumination device including a light emitting diode and an illumination lens having a cylindrical shape that controls the distribution of light emitted from the light emitting diode. FIG. 1 is a cross-sectional view of illumination device 1 including illumination lens 2 having a cylindrical shape disclosed in Patent Literature 1.

Also, illumination equipment that controls the distribution of light emitted from a light emitting diode by using an illumination lens having a symmetric shape with respect to the optical axis of the light emitting diode is known (for example, Patent Literature 2). The illumination lenses described in Patent Literature 1 and Patent Literature 2 each can condense and emit the light emitted from a light source so that the light having a sufficient light quantity may be delivered to a site of the illuminated surface located away from the light source.

CITATION LIST

Patent Literature

PTL 1: Japanese Patent Application Laid-open (JP-A) No. 2009-289506

PTL 2: Japanese Patent Application Laid-open (JP-A) No. 2007-5218

SUMMARY OF INVENTION

Technical Problem

However, the technique of Patent Literature 1 has a problem in that a locally bright part is liable to be generated in a region close to the light source among the regions of the illuminated surface that the light flux emitted from illumination lens 2 reaches when the thickness t1 (See FIG. 1) of illumination device 1 is reduced. Also, when an illumination lens described in Patent Literature 2 is used in place of illumination lens 2 having a cylindrical shape in illumination device 1 of Patent Literature 1, a dark part is liable to be generated in a region of the illuminated surface between adjacent illumination lenses where the light quantity is insufficient while a locally bright part is generated in a region of the illuminated surface close to the light source. This deteriorates the quality of the emission surface of the plane light source device (illumination device).

An object of the present invention is to provide a light emitting device and an illumination device that can restrain the generation of bright parts on the illuminated surface to improve the quality on the illuminated surface by controlling the light so that the light conventionally radiated onto a region of the illuminated surface close to the light source may be radiated also to a region of the illuminated surface located away from the light source.

Solution to Problem

In order to achieve the aforementioned object, the light emitting device of the present invention adopts a construction of having a light source, a first light flux controlling member for controlling the distribution of light emitted from the light source, and a second light flux controlling member for controlling the distribution of the light emitted from the first light flux controlling member, wherein the second light flux controlling member has an incidence surface onto which the light emitted from the first light flux controlling member is incident and an emission surface that is located on a side opposite to the incidence surface and emits the light incident from the incidence surface, and at least one surface of the incidence surface and the emission surface has an optical path converting region that refracts the light having an optical path on a virtual cross-section including the optical axis of the light source and being incident onto the one surface to the optical axis side.

The illumination device of the present invention adopts a construction of having a light emitting device described above and an illuminated surface that is disposed to be perpendicular to the virtual cross-section and in parallel to the optical axis and is illuminated by the light emitting device.

Advantageous Effects of Invention

According to the present invention, generation of bright parts on the illuminated surface can be restrained and the quality on the illuminated surface can be improved by controlling the light so that the light conventionally radiated onto a region of the illuminated surface close to the light source may be radiated also to a region of the illuminated surface located away from the light source.

DESCRIPTION OF EMBODIMENTS

Hereafter, embodiments of the present invention will be described in detail with reference to the drawings.

Embodiment 1

(Construction of Light Emitting Device)

Figure 1:
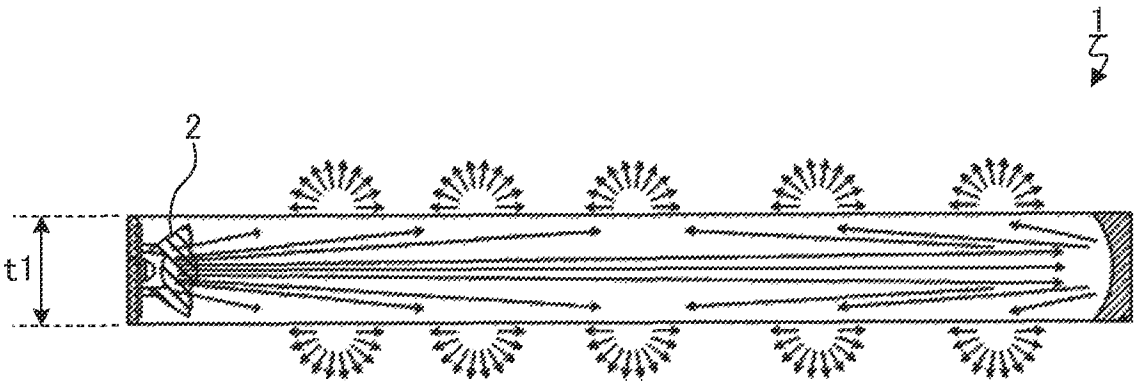
FIG. 1 is a cross-sectional view of an illumination device including an illumination lens having a cylindrical shape described in Patent Literature 1.
Figure 2:
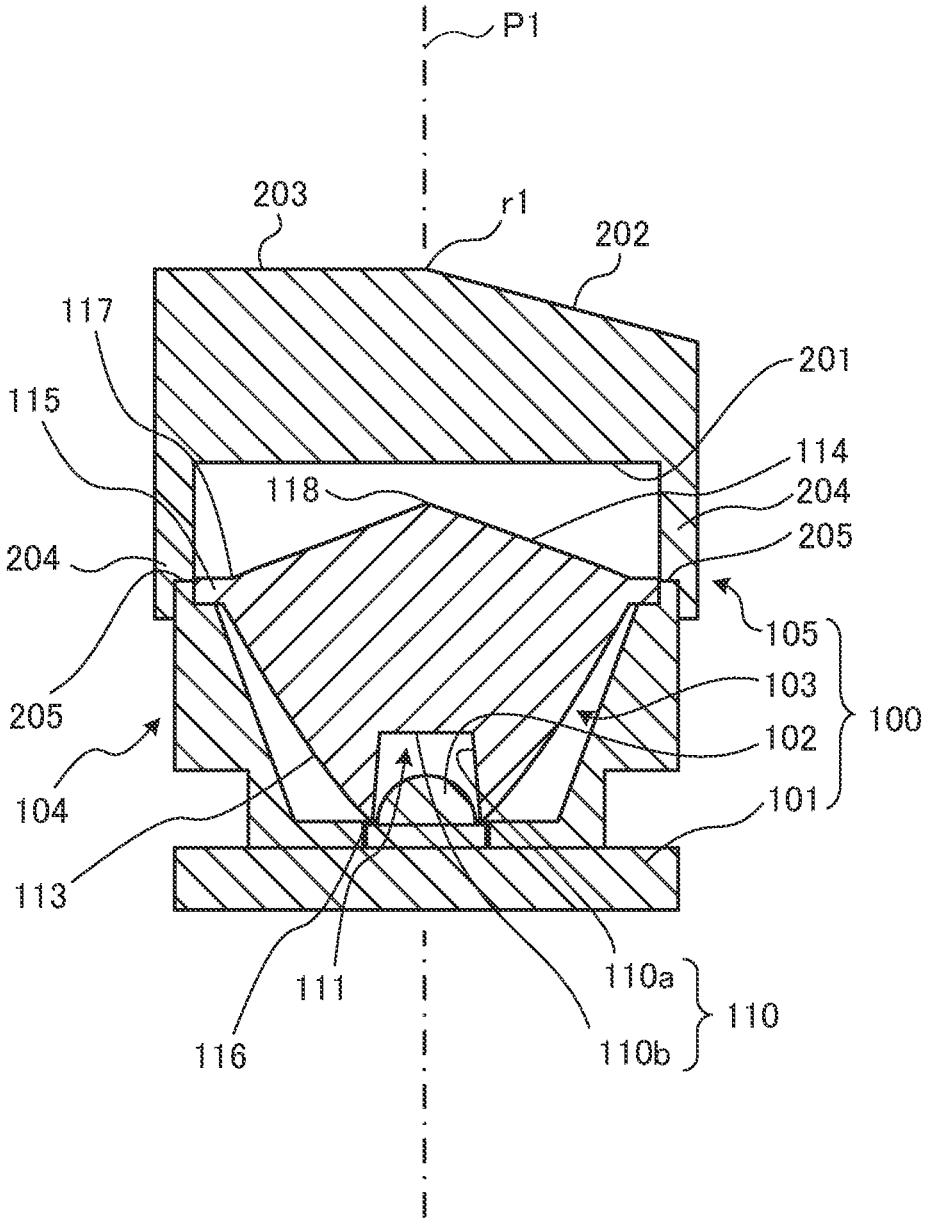
FIG. 2 is a cross-sectional view of a light emitting device according to Embodiment 1 of the present invention.

FIG. 2 is a cross-sectional view of light emitting device 100 according to Embodiment 1 of the present invention.

Light emitting device 100 is mainly constructed with substrate 101, light emitting element 102, first light flux controlling member 103, and second light flux controlling member 105.

Light emitting element 102 is a light source mounted on substrate 101 and is, for example, a white LED.

First light flux controlling member 103 is positioned so that the central axis thereof may coincide with the optical axis P1 of light emitting element 102. In the present embodiment, first light flux controlling member 103 is housed in the inside of holder 104 that is fixed to substrate 101. Also, first light flux controlling member 103 receives incidence of the light emitted from light emitting element 102 and emits the light controlled in such a manner that the distribution of the light emitted from first light flux controlling member 103 will be narrower than the distribution of the light emitted from light emitting element 102.

Holder 104 has a hollow tubular shape and is mounted onto substrate 101 so that the central axis thereof may coincide with the optical axis P1 of light emitting element 102. Also, holder 104 houses first light flux controlling member 103 and positions first light flux controlling member 103 onto substrate 101.

Second light flux controlling member 105 is disposed to have a predetermined gap to first light flux controlling member 103 on the emission surface side of first light flux controlling member 103. In the present embodiment, second light flux controlling member 105 is fixed in a state of being engaged with holder 104. Also, second light flux controlling member 105 receives incidence of the light emitted from first light flux controlling member 103, controls the distribution of the incident light, and illuminates a not-illustrated surface to be illuminated by the light with controlled distribution.

(Construction of First Light Flux Controlling Member)

Hereafter, the construction of first light flux controlling member 103 will be described in detail with use of FIG. 2.

First light flux controlling member 103 has first incidence surface 110, concave part 111, total reflection surface 113, first emission surface 114, flange section 115, and bottom surface 116.

First incidence surface 110 is formed on the inner surface of concave part 111 that is formed by indenting bottom surface 116 opposite to light emitting element 102 to the inside and is formed to be rotationally symmetric around the central axis (optical axis P1). Also, first incidence surface 110 has inner ceiling surface 110*a* formed on the inner surface of concave part 111 and taper-shaped inner wall surface 110*b* extending from the outer edge of inner ceiling surface 110*a* to the opening edge of concave part 111. Here, the inner diameter of inner wall surface 110*b* gradually increases according as it goes from the inner ceiling surface 110*a* side towards the opening edge side of concave part 111.

Total reflection surface 113 is an outer surface extending from the outer circumferential section of bottom surface 116 to the lower surface of flange section 115 and is a rotationally symmetric surface formed to surround the central axis. Also, total reflection surface 113 is formed to increase in diameter from the outer edge of bottom surface 116 towards first emission surface 114, where the outer diameter gradually increases according as it goes from bottom surface 116 towards flange section 115, and the generatrix thereof has a circular arc curve being convex to the outside (the side going away from the central axis).

First emission surface 114 has a circular shape such that the shape projected onto a plane has a center on the central axis. Also, first emission surface 114 has apex 118 at a predetermined position of the central axis and is smoothly inclined from apex 118 towards outer circumferential section 117 of first emission surface 114 so that the height from bottom surface 116 may gradually decrease. Also, first emission surface 114 is formed to be warped in a convex shape upwards (in the direction going away from bottom surface 116).

Flange section 115 is formed to protrude from outer circumferential section 117 of first emission surface 114 to the outer side in the radial direction and has a generally annular shape.

Bottom surface 116 is a ring-shaped plane formed in the surroundings of the opening edge of concave part 111.

(Construction of Second Light Flux Controlling Member)

Hereafter, the construction of second light flux controlling member 105 will be described in detail with use of FIG. 2, FIG. 3A and FIG. 3B.

Figure 3A:
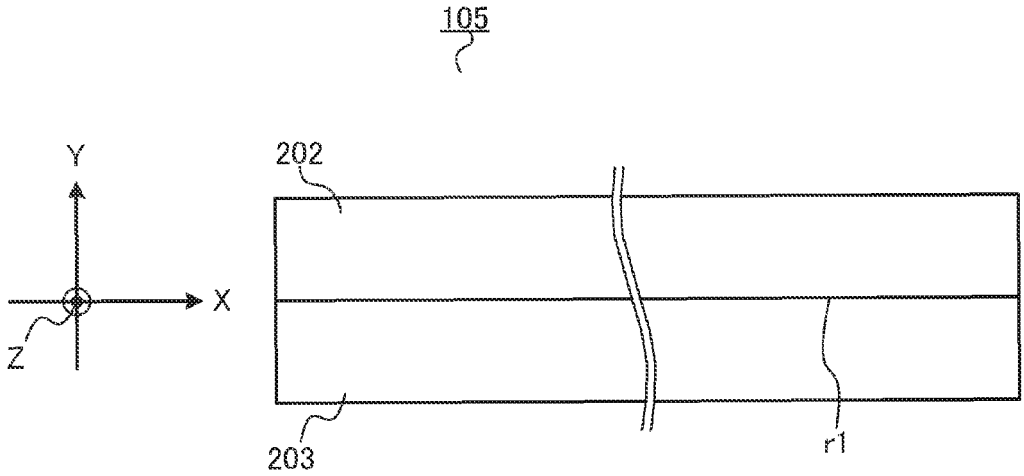
FIG. 3A is a plan view of a second light flux controlling member in Embodiment 1 of the present invention.

FIG. 3A is a plan view of second light flux controlling member 105. Also, FIG. 3B is a side view of second light flux controlling member 105.

Second light flux controlling member 105 has second incidence surface 201 and second emission surface 202, and is formed to have a plate shape. In the present embodiment, second light flux controlling member 105 further has third emission surface 203 connected to second emission surface 202, leg section 204 for positioning second light flux controlling member 105 relative to first light flux controlling member 103, and engagement section 205 for being engaged with first light flux controlling member 103.

Second incidence surface 201 is an approximately flat plane perpendicular to the central axis (optical axis P1) and is disposed to oppose at a predetermined distance to first emission surface 114 of first light flux controlling member 103. Second incidence surface 201 receives incidence of the light emitted from first emission surface 114. Also, second incidence surface 201 is provided with leg sections 204 at both ends of the width direction (direction parallel to the Y-axis in FIGS. 3A and 3B) of second light flux controlling member 105.

Second emission surface 202 is disposed on a surface opposite to second incidence surface 201. Also, in a virtual cross-section S containing the central axis (optical axis P1) and being perpendicular to later-mentioned illuminated member 301, second emission surface 202 is formed to decrease the thickness of second light flux controlling member 105 (distance between second incidence surface 201 and second emission surface 202) gradually, and functions as an optical path converting region. In other words, second emission surface 202 is formed as an inclined plane that is inclined at a predetermined angle to the second incidence surface. Also, second emission surface 202 is a flat plane in the present embodiment. Further, at a position at which the distance between second incidence surface 201 and second emission surface 202 (thickness of second light flux controlling member 105) attains the maximum, second emission surface 202 is connected to third emission surface 203. In other words, second emission surface 202 is gradually inclined to a position lower by h1 than third emission surface 203 from the same height as that of third emission surface 203 in a height direction of second light flux controlling member 105 (direction parallel to the Z-axis in FIGS. 3A and 3B). Also, second emission surface 202 functioning as an optical path converting region refracts the light having an optical path on the aforementioned virtual cross-section S and being incident (internal incidence) onto second emission surface 202 more to the optical axis P1 side than when being incident (internal incidence) onto a plane perpendicular to the optical axis P1.

Third emission surface 203 is an approximately flat plane parallel to second incidence surface 201 and perpendicular to the optical axis P1. Also, the boundary line r1 at which second emission surface 202 and third emission surface 203 are connected will be a straight line that passes through a predetermined point on the optical axis P1 and is perpendicular to the optical axis P1 and the aforementioned virtual cross-section S. Because second incidence surface 201 and third emission surface 203 are formed to be parallel, the exit angle of the light emitted from third emission surface 203 will be equal to the incidence angle when being incident onto second incidence surface 201.

Leg sections 204 are disposed to extend from second incidence surface 201 to the outside (light emitting element 102 side) and are formed as a pair integral with second incidence surface 201. Also, leg sections 204 are provided, at the lower ends thereof, with engagement sections 205 that are engaged with the upper ends of holder 104.

Engagement sections 205 are engaged with open ends of holder 104 that are open to the outside for making first light flux controlling member 103 freely attachable and detachable relative to holder 104, so as to position and fix second light flux controlling member 105 onto holder 104. This allows that second incidence surface 201 is disposed to oppose first emission surface 114 at a predetermined interval.

(Construction of Illumination Device)

Hereafter, a construction of illumination device 300 will be described with reference to FIGS. 4 and 5.

Figure 4:
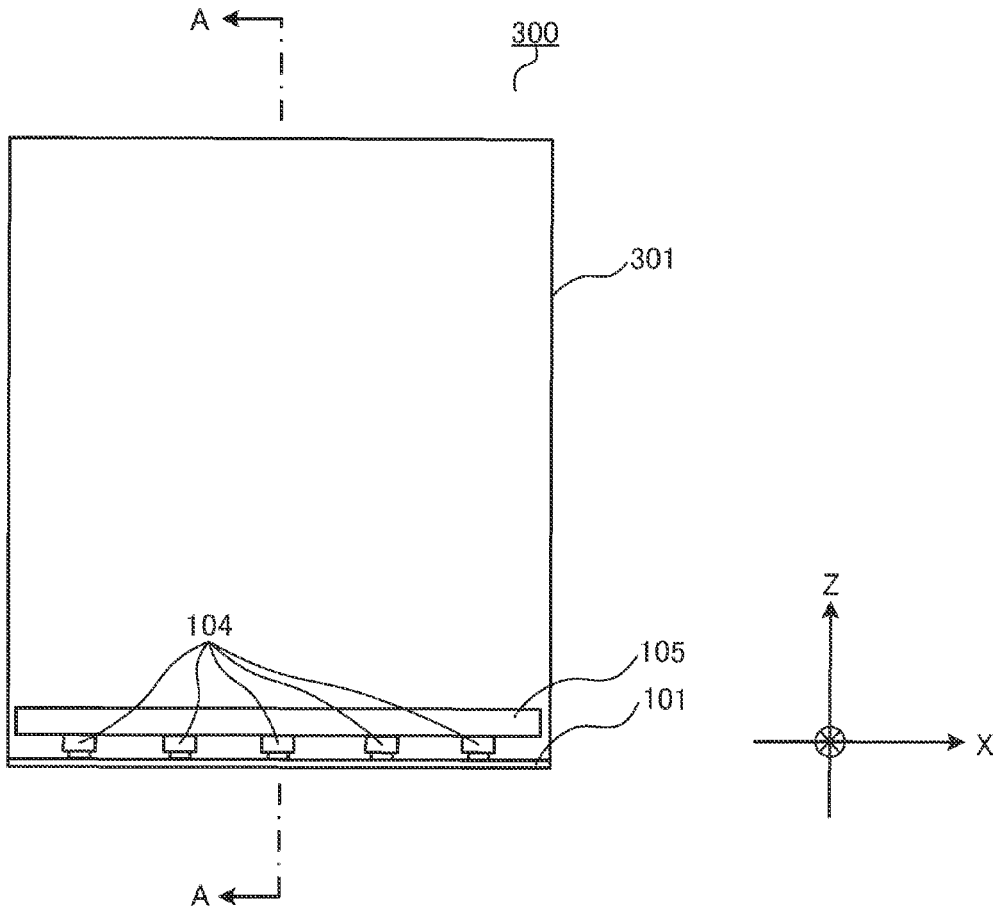
FIG. 4 is a front view of an illumination device according to Embodiment 1 of the present invention.
Figure 5:
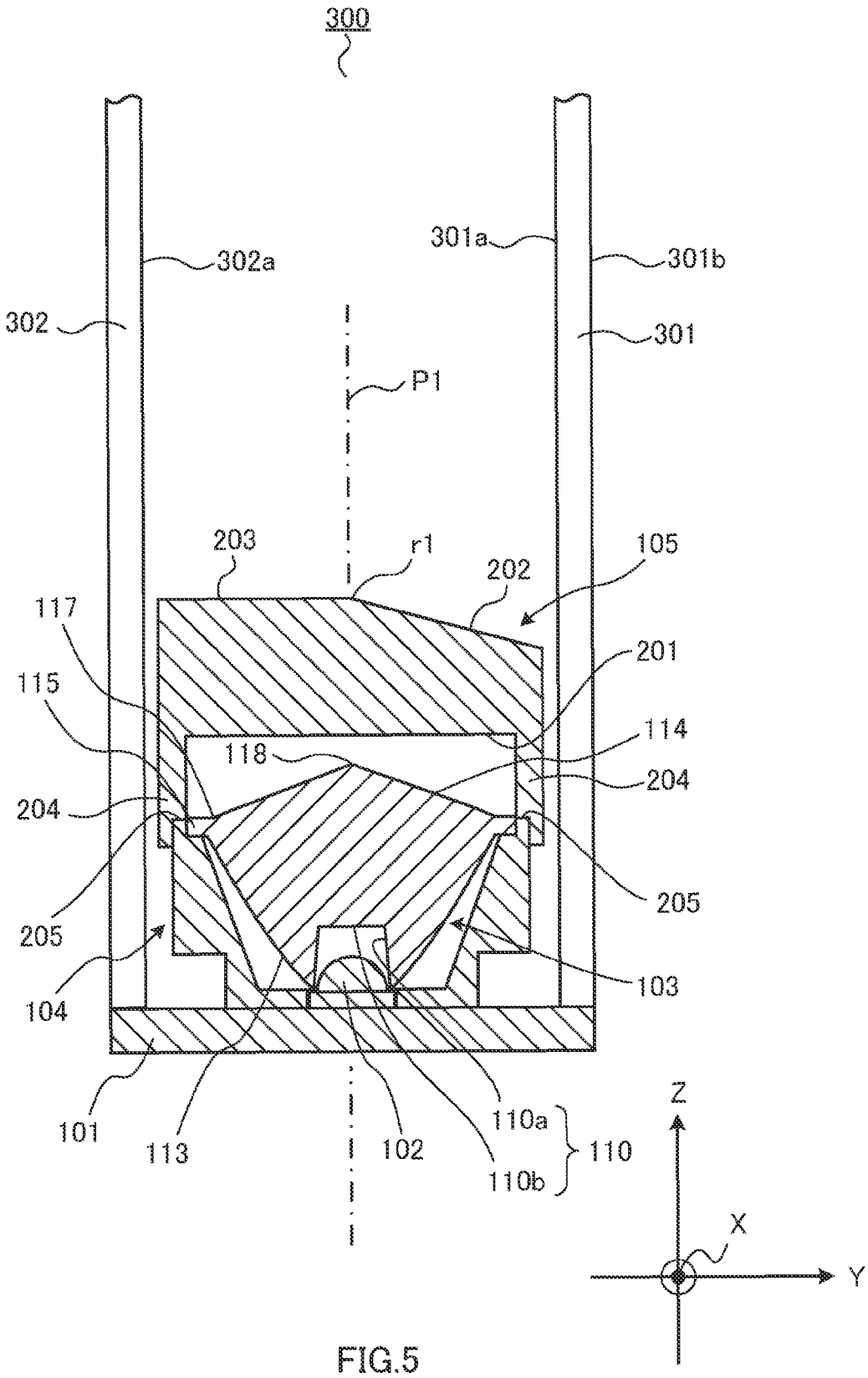
FIG. 5 is an enlarged view of an essential part of the A-A line cross-section of FIG. 4.

FIG. 4 is a front view of illumination device 300, and FIG. 5 is a view showing an essential part of the A-A line cross-section of FIG. 4. Here, for the sake of description, FIG. 4 shows a state in which the opposing illuminated member 302 shown in FIG. 5 is removed.

Illumination device 300 is mainly constructed with light emitting device 100, illuminated member 301, and opposing illuminated member 302. Illuminated member 301 and opposing illuminated member 302 are respectively provided with illuminated surface 301*a* and opposing illuminated surface 302*a* which are incidence surfaces of the light emitted from light emitting device 100. Here, light emitting device 100 is constructed with a plurality of light emitting elements 102 mounted on substrate 101, a plurality of first light flux controlling members 103 and holders 104 that are mounted in one-to-one correspondence to these plural light emitting elements 102, and second light flux controlling member 105 that is disposed to cover first emission surfaces 114 of these plural first light flux controlling members 103. The construction and the positioning of the members constituting light emitting device 100 are the same as those of light emitting element 100 shown in FIGS. 2 to 3B described above, so that the description thereof will be omitted.

A plurality of light emitting devices 100 are disposed to be arranged at a predetermined interval in a direction parallel to the X-axis of FIGS. 4 and 5. In other words, a plurality of light emitting elements 102, a plurality of first light flux controlling members 103, and a plurality of holders 104 are disposed to be arranged at a predetermined interval in a direction parallel to the X-axis of FIGS. 4 and 5. Also, each light emitting device 100 is disposed so that the above-described virtual cross-section S and the illuminated surface 301*a* will be perpendicular to each other and second emission surface 202 of second light flux controlling member 105 will be on the illuminated surface 301*a* side.

Illuminated member 301 has a rectangular shape and is a flat plane parallel to the X-Z plane of FIGS. 4 and 5. For example, characters, pictures, or the like for advertisement are drawn on emission surface 301*b* of illuminated member 301. Alternatively, a liquid crystal panel is disposed on emission surface 301*b* of illuminated member 301. Also, illuminated member 301 is illuminated from the inside by light emitting device 100 and is formed of a diffusion plate or the like that diffuses and transmits the light from light emitting device 100 to the outside.

Opposing illuminated member 302 is a flat plane parallel to the X-Z plane of FIGS. 4 and 5 having an opposing illuminated surface 302*a* that opposes illuminated surface 301*a*. Opposing illuminated member 302 is illuminated from the inside by light emitting device 100. In the present embodiment, opposing illuminated surface 302*a* is formed of a light reflection plate having a reflection property.

(Path of Light in Illumination Device)

Hereafter, the path of light in illumination device 300 will be described with reference to FIGS. 6 to 9. Here, in FIGS. 6 to 9, illustration of holder 104 will be omitted in order to facilitate the understanding of the path of light from light emitting element 102.

Figure 6:
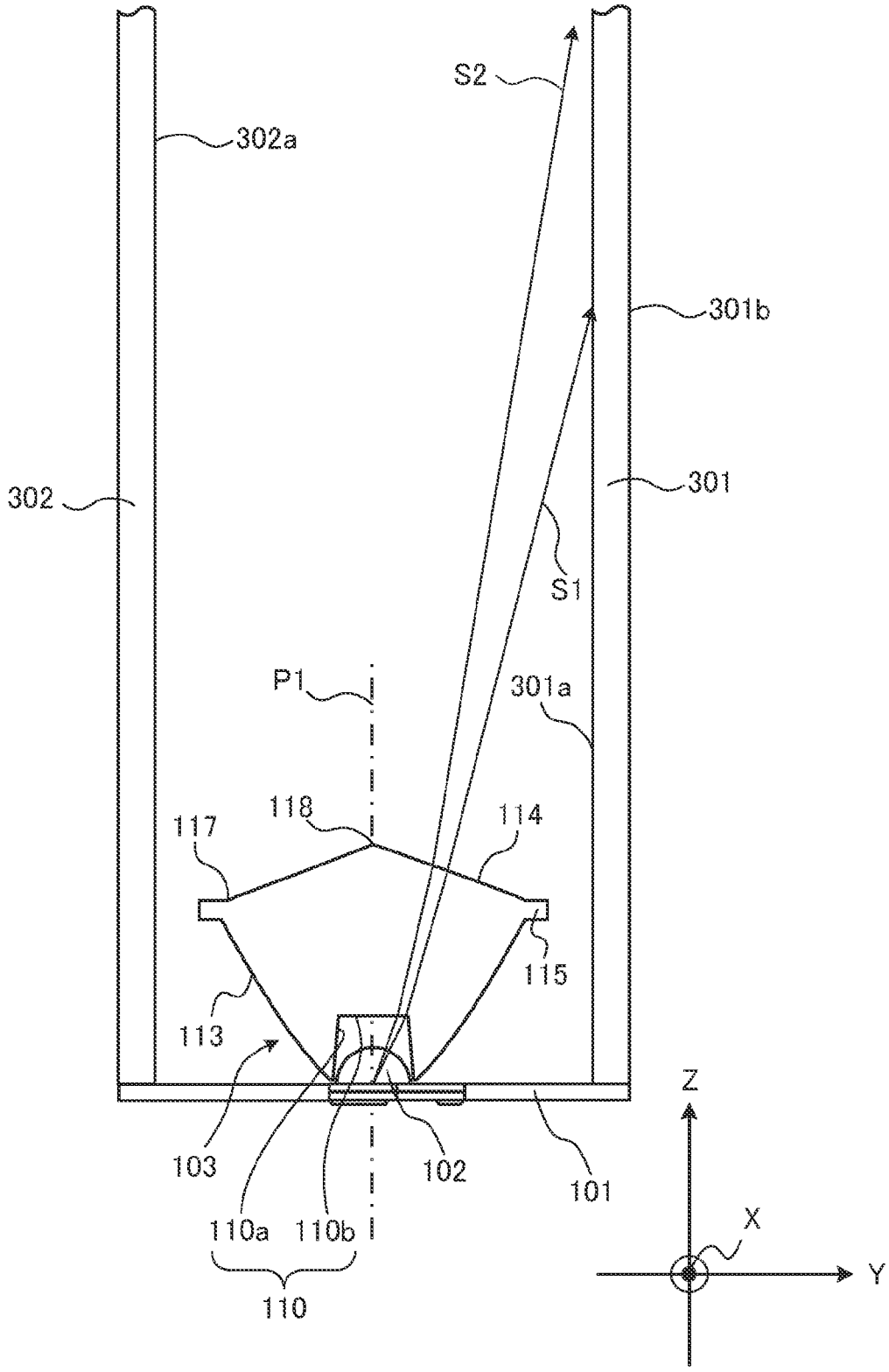
FIG. 6 is a view showing a path of light near the light emitting element when the second light flux controlling member is not used.
Figure 7:
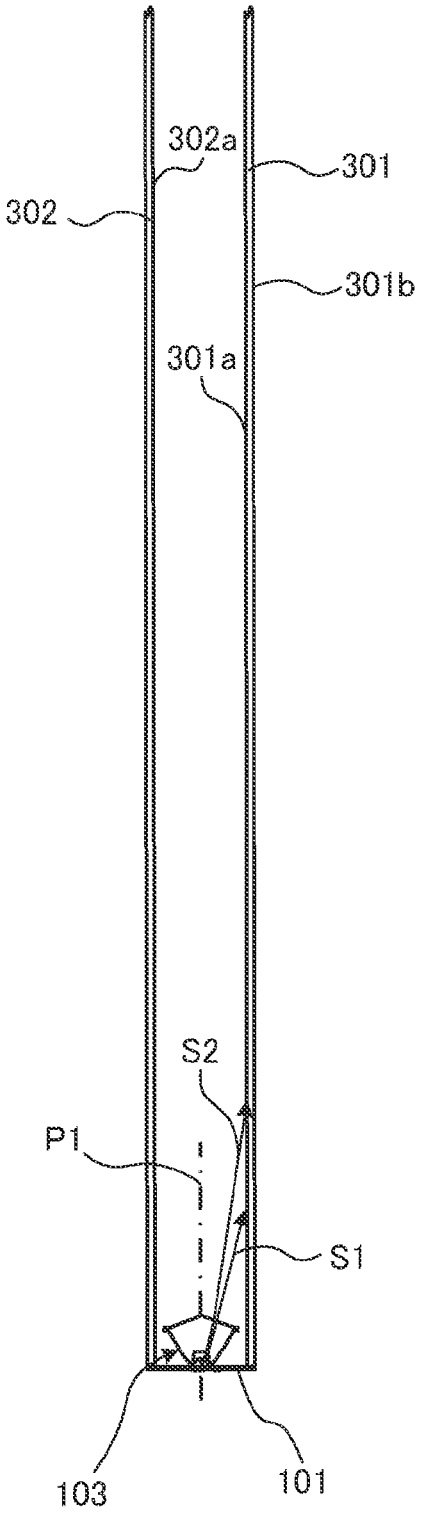
FIG. 7 is a view showing a path of light in an illumination device when the second light flux controlling member is not used.
Figure 8:
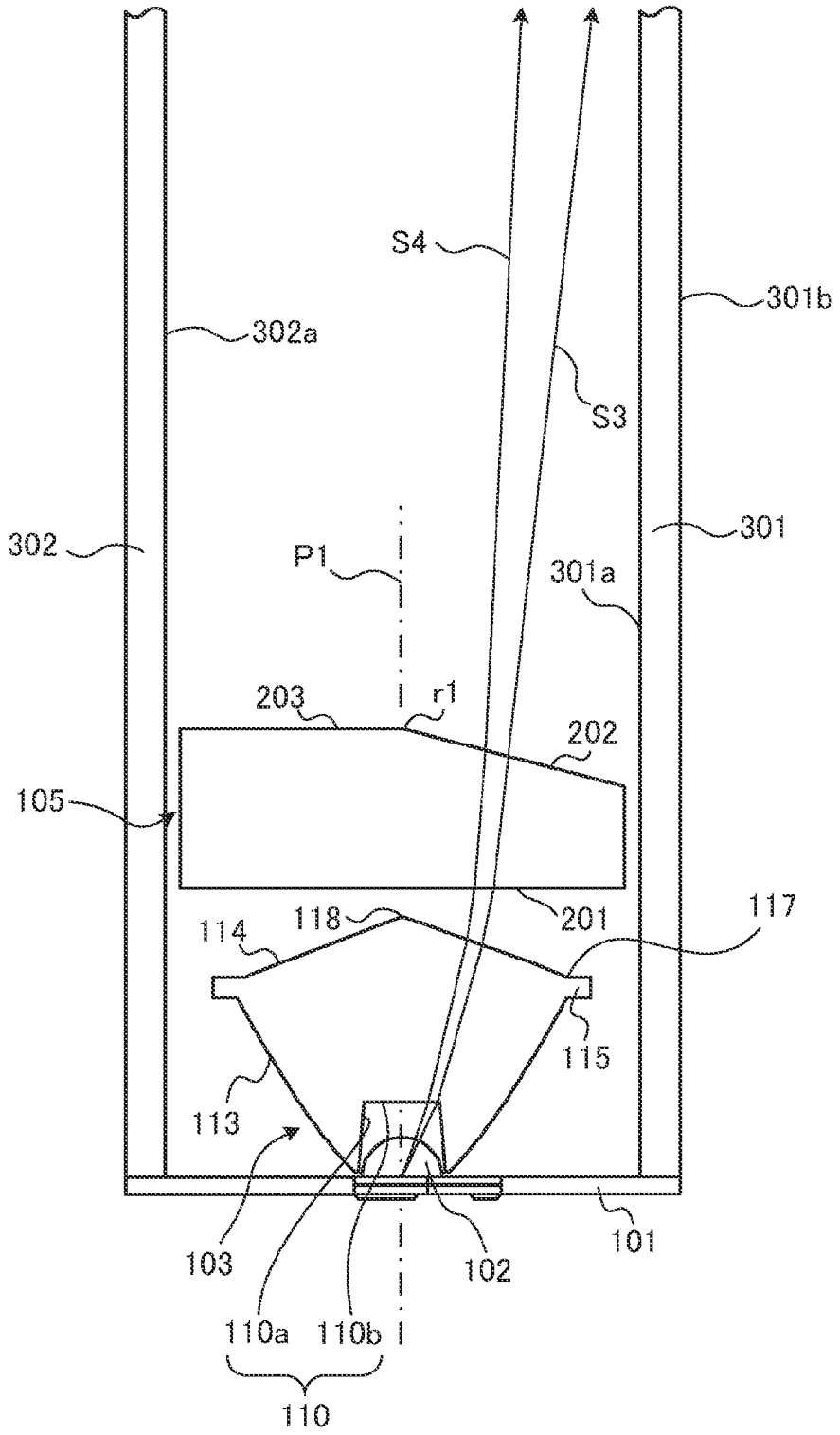
FIG. 8 is a view showing a path of light near the light emitting element in the illumination device according to Embodiment 1 of the present invention.
Figure 9:
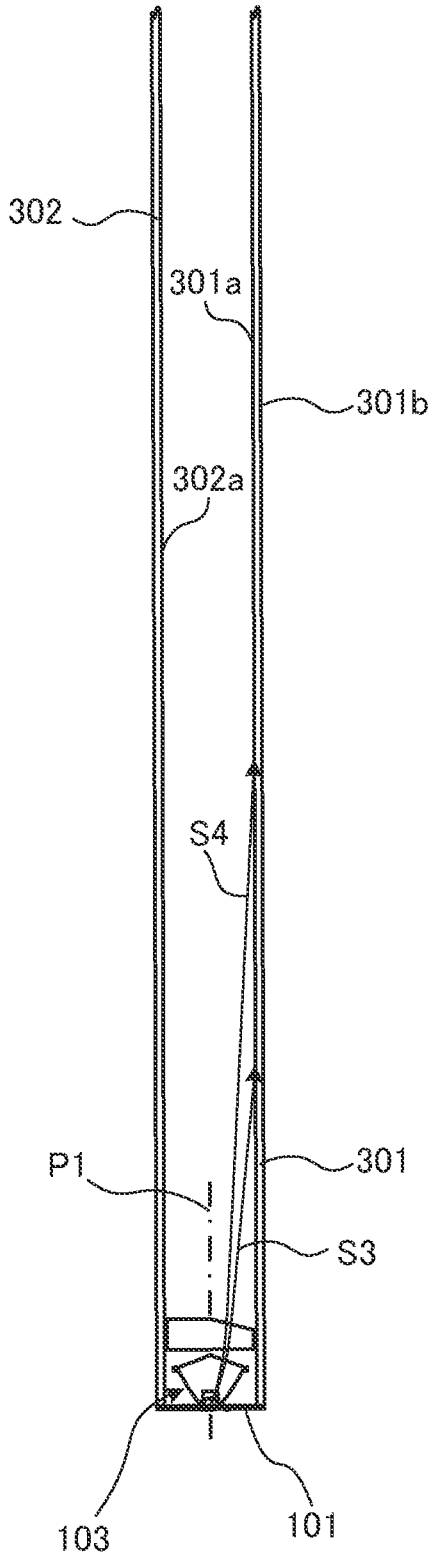
FIG. 9 is a view showing a path of light in the illumination device according to Embodiment 1 of the present invention.

FIG. 6 is a view showing a path of light near light emitting element 102 in a case in which second light flux controlling member 105 is not used. Also, FIG. 7 is a view showing a path of light in the illumination device in a case in which second light flux controlling member 105 is not used. FIG. 8 is a view showing a path of light near light emitting element 102 in illumination device 300 according to the present embodiment. FIG. 9 is a view showing a path of light in illumination device 300 according to the present embodiment.

FIGS. 6 and 7 show the light that passes through first light flux controlling member 103 and goes along the paths of S1 and S2 among the light emitted from light emitting element 102. First light flux controlling member 103 controls so that the light emitted from light emitting element 102 and having a wide-angle light distribution property will have a narrow-angle light distribution property. According as the light distribution property of first light flux controlling member 103 disposed at one side of illumination device 300 has a narrower angle, the light can be radiated to a position located farther away from light emitting element 102 of illuminated surface 301*a*. Also, when the interval between illuminated surface 301*a* and opposing illuminated surface 302*a* is small (when the thickness in the Y-direction of FIG. 6 is small), the brightness on illuminated surface 301*a* (or on emission surface 301*b* of illuminated member 301) can be made uniform.

However, in an illumination device in which illuminated surface 301*a* is illuminated with light by using only first light flux controlling member 103 without using second light flux controlling member 105, the unevenness of brightness existing between illuminated positions on illuminated surface 301*a* that receive the light emitted from first light flux controlling member 103 and non-illuminated positions that do not receive the light will be definite. For this reason, a region having a strong contrast of brightness and darkness is generated on illuminated surface 301*a* near light emitting element 102, so that unevenness of brightness is generated on emission surface 301*b*. As a result, the quality of emission surface 301*b* of illuminated member 301 will be aggravated.

In FIGS. 8 and 9, the light that goes along the paths of S1 and S2 shown in FIGS. 6 and 7 among the light emitted from light emitting element 102 is refracted by second light flux controlling member 105 to go along the paths of S3 and S4. In this manner, in illumination device 300 according to the present embodiment, the light that is radiated to illuminated surface 301*a* near light emitting element 102 in FIGS. 6 and 7 can be converted to the light that is radiated to a position located away from light emitting element 102 by using second light flux controlling member 105. Therefore, in the present embodiment, the light that is directed to a region that is liable to become a bright part on illuminated surface 301*a* can be distributed also to a region located away from light emitting element 102, so that the unevenness of brightness at the emission surface 301*b* of illuminated member 301 can be restrained.

(Relationship Between Shape of Second Light Flux Controlling Member and Path of Light)

Hereafter, a relationship between the shape of second light flux controlling member 105 and the path of light will be described with reference to FIGS. 10 to 13.

Figure 10:
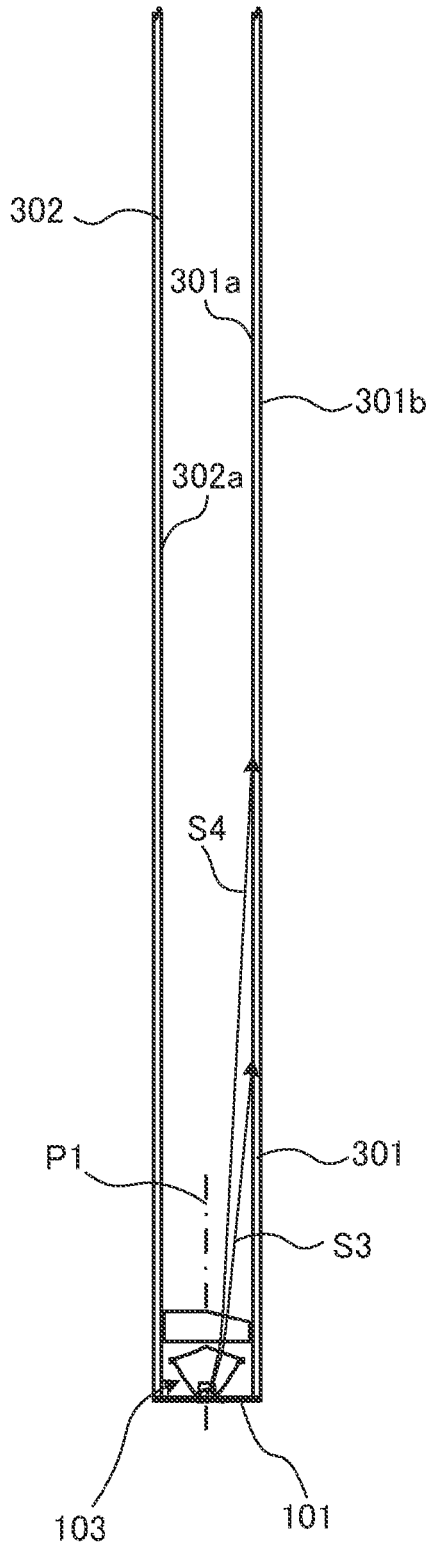
FIG. 10 is a view showing a path of light near the light emitting element in the first modification of the second light flux controlling member in Embodiment 1 of the present invention.
Figure 11:
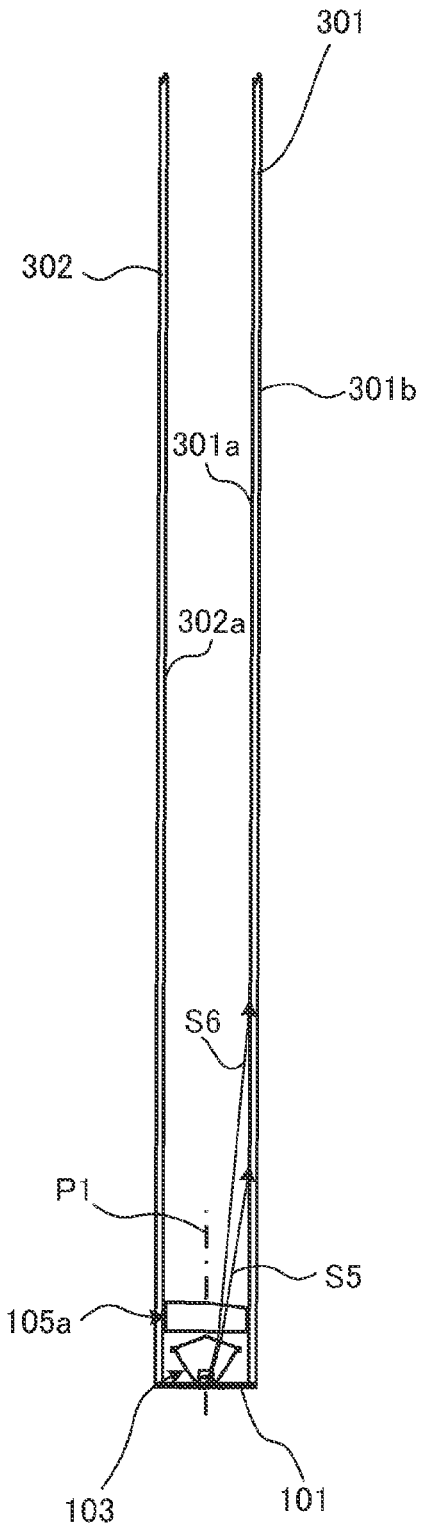
FIG. 11 is a view showing a path of light in the illumination device in the first modification of the second light flux controlling member in Embodiment 1 of the present invention.

FIG. 10 is a view showing a path of light near light emitting element 102 of illumination device 300 in a case in which second light flux controlling member 105*a*, which is a first modification of second light flux controlling member 105, is used. Also, FIG. 11 is a view showing a path of light in illumination device 300 in a case in which second light flux controlling member 105*a*, which is the first modification of second light flux controlling member 105, is used. Here, in FIGS. 10 and 11, the parts other than second light flux controlling member 105*a* have the same construction as those of light emitting device 100 and illumination device 300 described above in FIGS. 2 to 5.

In FIGS. 10 and 11, the light that goes along the paths of S1 and S2 shown in FIGS. 6 and 7 is refracted by second light flux controlling member 105*a* to go along the paths of S5 and S6.

Figure 12:
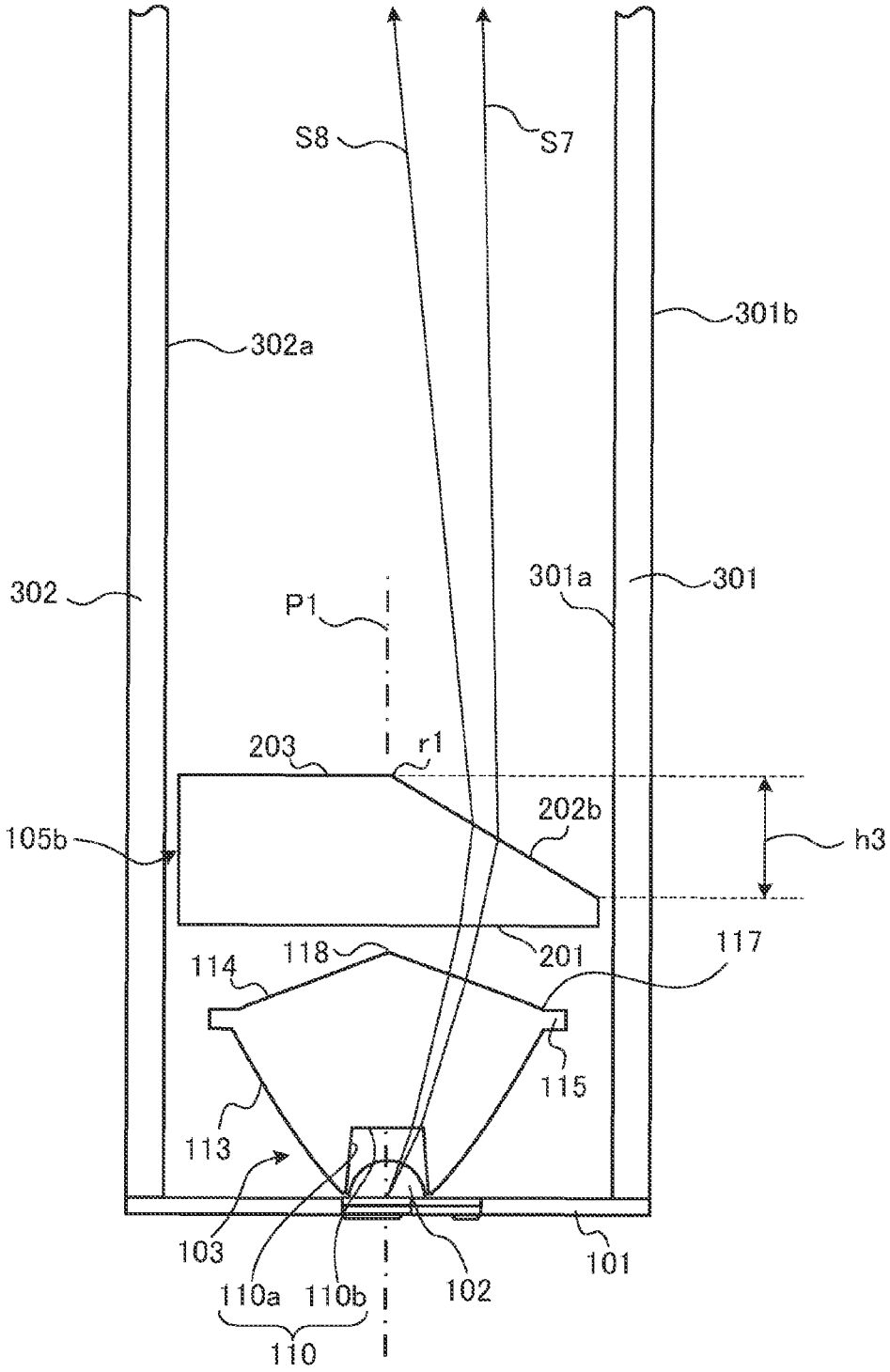
FIG. 12 is a view showing a path of light near the light emitting device in the second modification of the second light flux controlling member in Embodiment 1 of the present invention.
Figure 13:
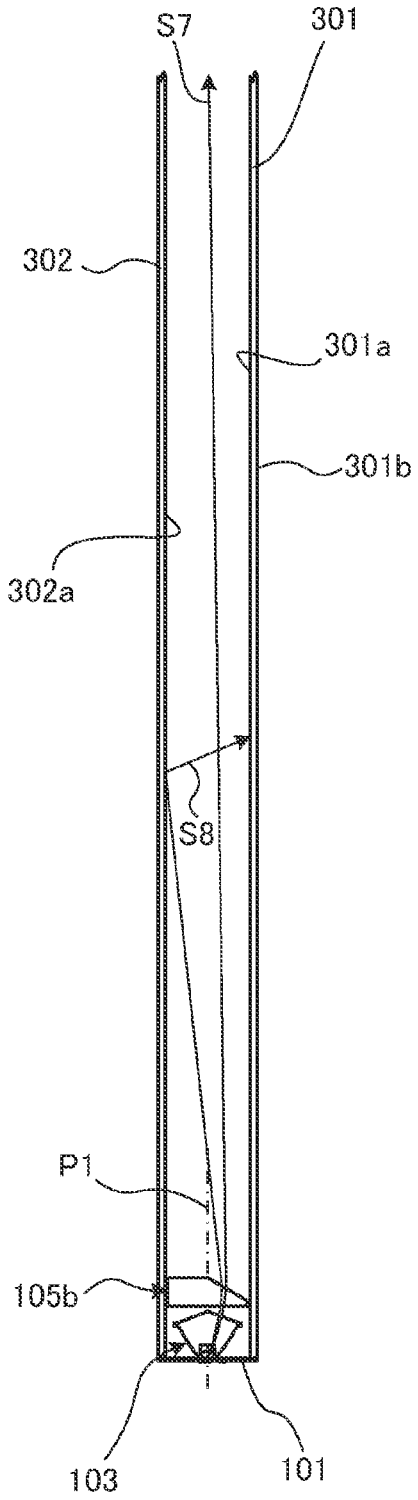
FIG. 13 is a view showing a path of light in the illumination device in the second modification of the second light flux controlling member in Embodiment 1 of the present invention.

Also, FIG. 12 is a view showing a path of light near light emitting element 102 of illumination device 300 in a case in which second light flux controlling member 105*b*, which is a second modification of second light flux controlling member 105, is used. Also, FIG. 13 is a view showing a path of light in illumination device 300 in a case in which second light flux controlling member 105*b*, which is the second modification of second light flux controlling member 105, is used. Here, in FIGS. 12 and 13, the parts other than second light flux controlling member 105*b* have the same construction as those of light emitting device 100 and illumination device 300 described above in FIGS. 2 to 5.

In FIGS. 12 and 13, the light that goes along the paths of S1 and S2 shown in FIGS. 6 and 7 is refracted by second light flux controlling member 105*b* to go along the paths of S5 and S6.

Figure 3B:
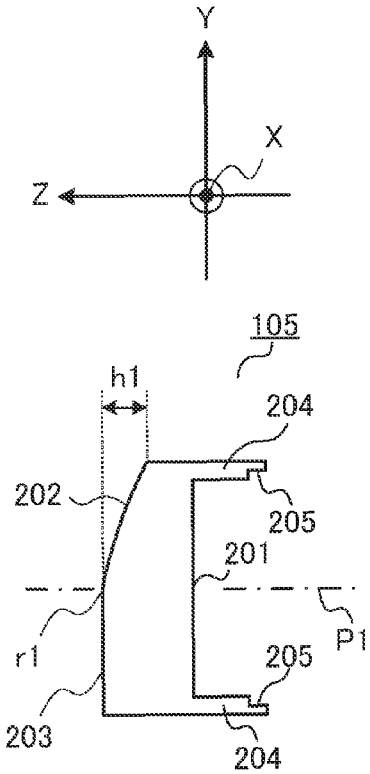
FIG. 3B is a side view of the second light flux controlling member in Embodiment 1 of the present invention.

In second light flux controlling member 105*a* shown in FIGS. 10 and 11, second emission surface 202*a* is a flat plane that is inclined more moderately than second emission surface 202 shown in FIG. 3B. In other words, the dimension h2 in the height direction of second light flux controlling member 105*a* for forming second emission surface 202*a* shown in FIGS. 10 and 11 is smaller than h1 shown in FIG. 3B.

Also, in second light flux controlling member 105*b* shown in FIGS. 12 and 13, second emission surface 202*b* is a flat plane that is inclined more sharply than second emission surface 202 shown in FIG. 3B. In other words, the dimension h3 in the height direction of second light flux controlling member 105*b* for forming second emission surface 202*b* shown in FIGS. 12 and 13 is larger than h1 shown in FIG. 3B. Also, in second light flux controlling member 105*b* shown in FIGS. 12 and 13, the light that is emitted from second emission surface 202*b* of second light flux controlling member 105*b* is reflected towards illuminated surface 301 by a light reflection plate of opposing illuminated surface 302 to go along the path S8 (See FIG. 13).

From FIGS. 10 to 13, in these modifications, the light that is refracted more to the optical axis P1 side can be emitted according as the degree of inclination of second emission surface 202 relative to second incidence surface 201 is increased. This is due to the fact that the refractive force increases according as the difference ($\Delta$t2), between the optical axis P1 side and the illuminated surface 301*a* side, of the distance (thickness t2) between second emission surface 202 and second incidence surface 201 increases. In this manner, the path of the light emitted from second emission surface 202 can be controlled by adjusting the degree of inclination of the plane formed on the illuminated surface 301*a* side of second light flux controlling member 105 (second emission surface 202 in the present embodiment) in forming second emission surface 202.

(Effects in the Present Embodiment)

In this manner, according to the present embodiment, by using the second light flux controlling member, the light emitted from the first light flux controlling member towards the illuminated surface near the light source is controlled so as to reach also the illuminated surface located away from the light source. This allows that, according to the present embodiment, the unevenness of brightness at the emission surface of the illuminated surface can be reduced.

Also, according to the present embodiment, the path of the light emitted from the second emission surface can be controlled by adjusting the inclination of the second emission surface of the second light flux controlling member.

(Modifications in the Present Embodiment)

In the present embodiment, the second emission surface is formed as an inclined surface that is inclined at an inclination degree of a predetermined angle relative to the second incidence surface. However, the present invention is not limited to this, so that the second emission surface may be a curved surface that protrudes in a convex shape to the outside (the side opposite to light emitting element 102) where a predetermined thickness difference is provided between the optical axis side and the illuminated surface side in the thickness of the second light flux controlling member.

Also, in the present embodiment, the second emission surface is formed so that the boundary line r1 of the second emission surface and the third emission surface will be perpendicular to the optical axis. However, the present invention is not limited to this, so that the width of the second emission surface (inclined surface) in the virtual cross-section S may be adjusted in accordance with the quality of illumination that is demanded for the illuminated surface. For example, a plane (flat plate part) parallel to the second incidence surface may be formed between the second emission surface and the third emission surface.

Embodiment 2

Figure 14:
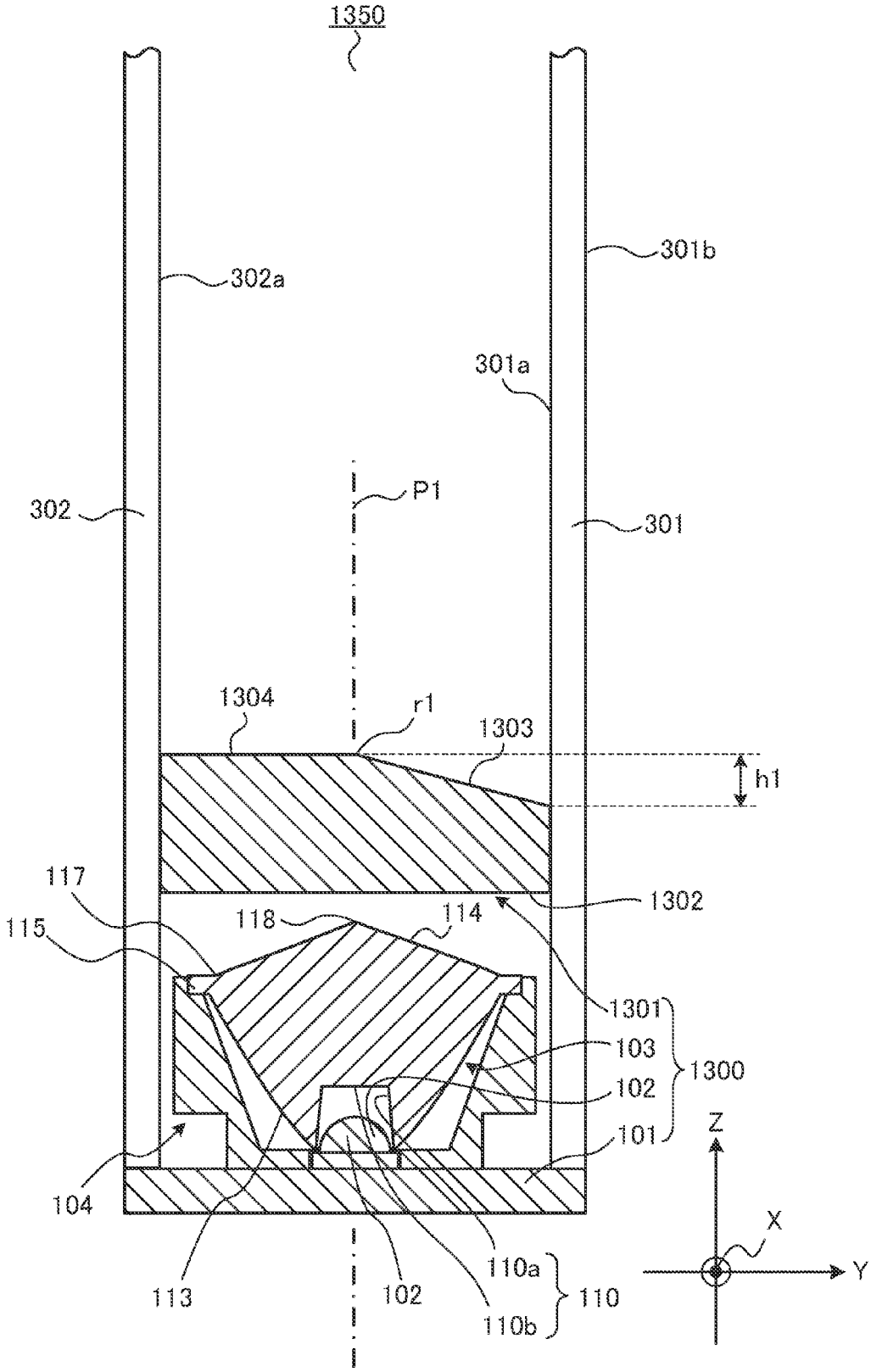
FIG. 14 is an enlarged view of an essential part of the A-A line cross-section of FIG. 4 of an illumination device according to Embodiment 2 of the present invention.

FIG. 14 is a cross-sectional view of illumination device 1350 according to Embodiment 2 of the present invention corresponding to the enlarged view of the essential part in the A-A line cross-section of FIG. 4. Here, in FIG. 14, the parts having the same construction as those in FIGS. 2 to 5 will be denoted with the same reference signs, and the description thereof will be omitted.

Light emitting device 1300 is mainly constructed with substrate 101, light emitting element 102, first light flux controlling member 103, and second light flux controlling member 1301.

Second light flux controlling member 1301 has second incidence surface 1302 and second emission surface 1303 and is formed to have a plate shape. In the present embodiment, second light flux controlling member 1301 further has third emission surface 1304 that is connected to second emission surface 1303. Also, at least one of the two surfaces that are formed to be perpendicular to second incidence surface 1302 and oppose illuminated surface 301 or opposing illuminated surface 302 is fixed to the opposing surface thereof (illuminated surface 301 or opposing illuminated surface 302), whereby second light flux controlling member 1301 is fixed between illuminated surface 301 and opposing illuminated surface 302. The method of fixation may be, for example, pressing into a gap between illuminated surface 301 and opposing illuminated surface 302, not-illustrated convex-concave fitting between illuminated surface 301 and opposing illuminated surface 302, or the like.

Second incidence surface 1302 is an approximately flat plane perpendicular to the optical axis P1 and is disposed to oppose at a predetermined distance to first emission surface 114 of first light flux controlling member 103. Second incidence surface 1302 receives incidence of the light emitted from first emission surface 114.

Second emission surface 1303 is disposed on a surface opposite to second incidence surface 1302. Also, in a virtual cross-section S containing the central axis (optical axis P1) and being perpendicular to illuminated member 301, second emission surface 1303 is formed to decrease the thickness of second light flux controlling member 1301 gradually. In other words, second emission surface 1303 is formed as an inclined plane that is inclined at an inclination degree of a predetermined angle to the second incidence surface. Second emission surface 1303 functions as an optical path converting region. Also, second emission surface 1303 is a flat plane in the present embodiment. Further, at a position at which the distance between second incidence surface 1302 and second emission surface 1303 (thickness of second light flux controlling member 1301) attains the maximum, second emission surface 1303 is connected to third emission surface 1304. In other words, second emission surface 1303 is gradually inclined to a position lower by h1 than third emission surface 1304 from the same height as that of third emission surface 1304 in a height direction of second light flux controlling member 1301 (direction parallel to the Z-axis in FIG. 14). Also, second emission surface 1303 functioning as an optical path converting region refracts the light having an optical path on the aforementioned virtual cross-section S and being incident (internal incidence) onto second emission surface 1303 more to the optical axis P1 side than when being incident (internal incidence) onto a plane perpendicular to the optical axis P1.

Third emission surface 1304 is an approximately flat plane parallel to second incidence surface 1302 and perpendicular to the optical axis P1. Also, the boundary line r1 at which second emission surface 1303 and third emission surface 1304 are connected will be a straight line that passes through a predetermined point on the optical axis P1 and is perpendicular to the optical axis P1 and the aforementioned virtual cross-section S. Because second incidence surface 1302 and third emission surface 1304 are formed to be parallel, the exit angle of the light emitted from third emission surface 1304 will be equal to the incidence angle when being incident onto second incidence surface 1302.

In illumination device 1350 that includes second light flux controlling member 1301 having the above-described construction, second light flux controlling member 1301 is disposed to oppose first emission surface 114 at a position located away by a predetermined distance from first emission surface 114 of first light flux controlling member 103. Here, the optical path of the light emitted from light emitting element 102 in illumination device 1350 is the same as that shown in FIGS. 8 and 9, so that the description thereof will be omitted.

In this manner, in the present embodiment, there is no need to provide a leg section or the like for being engaged with a holder in the second light flux controlling member. Therefore, according to the present embodiment, the construction of the second light flux controlling member can be simplified in addition to the effects of the above-described Embodiment 1, so that the second light flux controlling member can be produced more easily as compared with Embodiment 1.

Also, according to the present embodiment, the second light flux controlling member fixed to the illuminated surface and the opposing illuminated surface or the second light flux controlling member fixed to either one of the illuminated surface and the opposing illuminated surface can be let to function as one of the supporting members for keeping a distance between the illuminated surface and the opposing illuminated surface.

In the present embodiment, the second emission surface is formed as an inclined surface that is inclined at an inclination degree of a predetermined angle relative to the second incidence surface. However, the present invention is not limited to this, so that the second emission surface may be a curved surface that protrudes in a convex shape to the outside where a predetermined thickness difference is provided between the optical axis side and the illuminated surface side in the thickness of the second light flux controlling member.

Embodiment 3

(Construction of Light Emitting Device)

Hereafter, a construction of light emitting device 1400 according to the present embodiment will be described with reference to FIG. 15.

Figure 15:
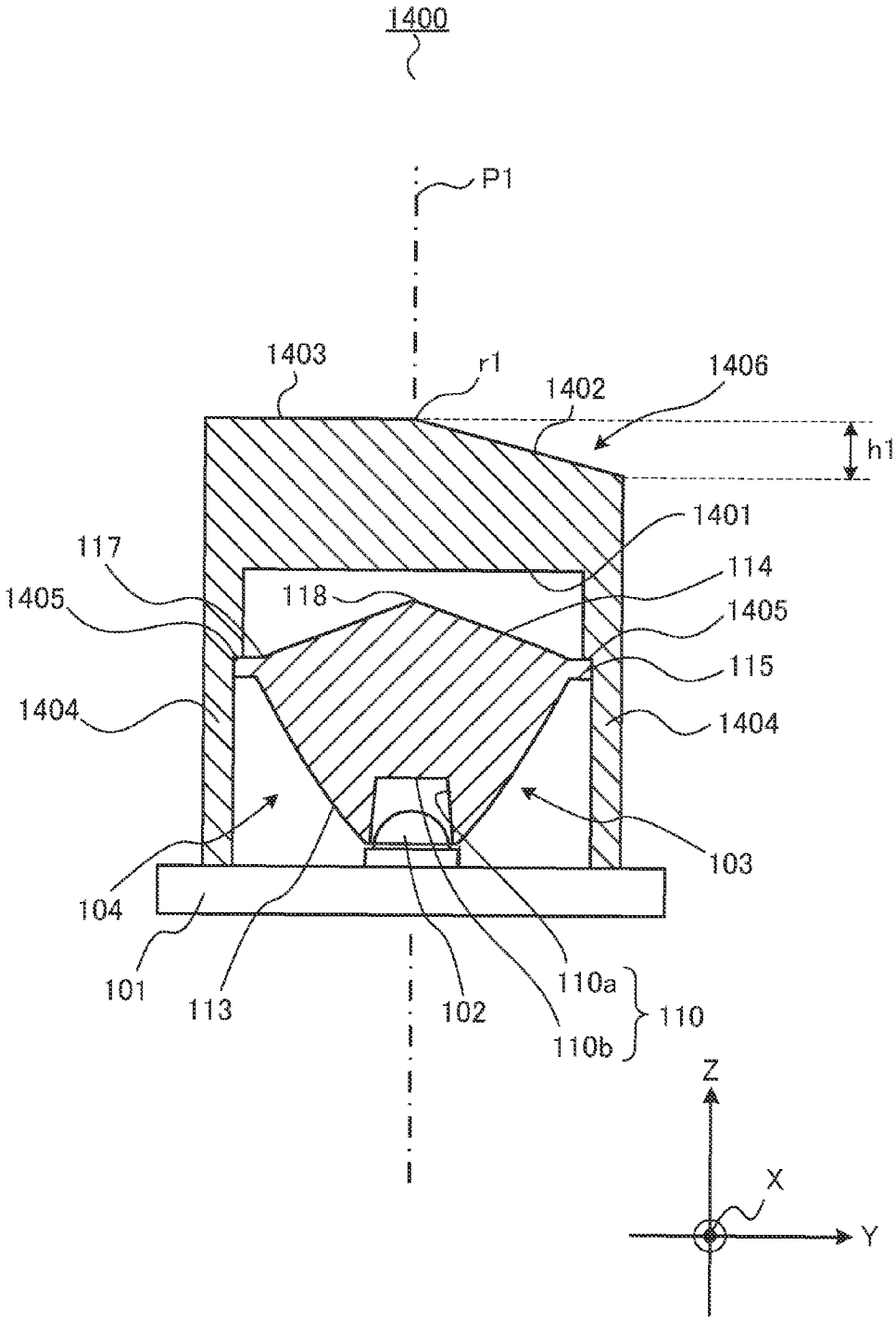
FIG. 15 is a cross-sectional view of a light emitting device according to Embodiment 3 of the present invention.

FIG. 15 is a cross-sectional view of light emitting device 1400 according to Embodiment 3 of the present invention. Here, in FIG. 15, the parts having the same construction as those of FIGS. 2 to 5 will be denoted with the same reference signs, and the description thereof will be omitted.

Light emitting device 1400 is mainly constructed with substrate 101, light emitting element 102, first light flux controlling member 103, and second light flux controlling member 1406.

First light flux controlling member 103 is positioned so that the central axis thereof may coincide with the optical axis P1 of light emitting element 102. Also, first light flux controlling member 103 is housed in the inside of second light flux controlling member 1406. Also, first light flux controlling member 103 receives incidence of the light emitted from light emitting element 102 and emits the light controlled in such a manner that the distribution of the light emitted from first light flux controlling member 103 will be narrower than the distribution of the light emitted from light emitting element 102.

Second light flux controlling member 1406 has generally an open-box shape in its cross-section cut along the width direction and is mounted onto substrate 101 so that the boundary line r1 and the optical axis of each light emitting element 102 will be perpendicular to each other. Also, second light flux controlling member 1406 houses first light flux controlling member 103 and positions first light flux controlling member 103 to substrate 101. Also, second light flux controlling member 1406 receives incidence of the light emitted from first light flux controlling member 103, controls the distribution of the incident light, and illuminates a not-illustrated surface to be illuminated by the light with controlled distribution. In this manner, second light flux controlling member 1406 functions both as a holder for housing first light flux controlling member 103 and as a light flux controlling member for controlling the distribution of the light emitted from first light flux controlling member 103.

(Construction of Second Light Flux Controlling Member)

Hereafter, the construction of second light flux controlling member 1406 will be described in detail with use of FIGS. 16 and 17.

Figure 16:
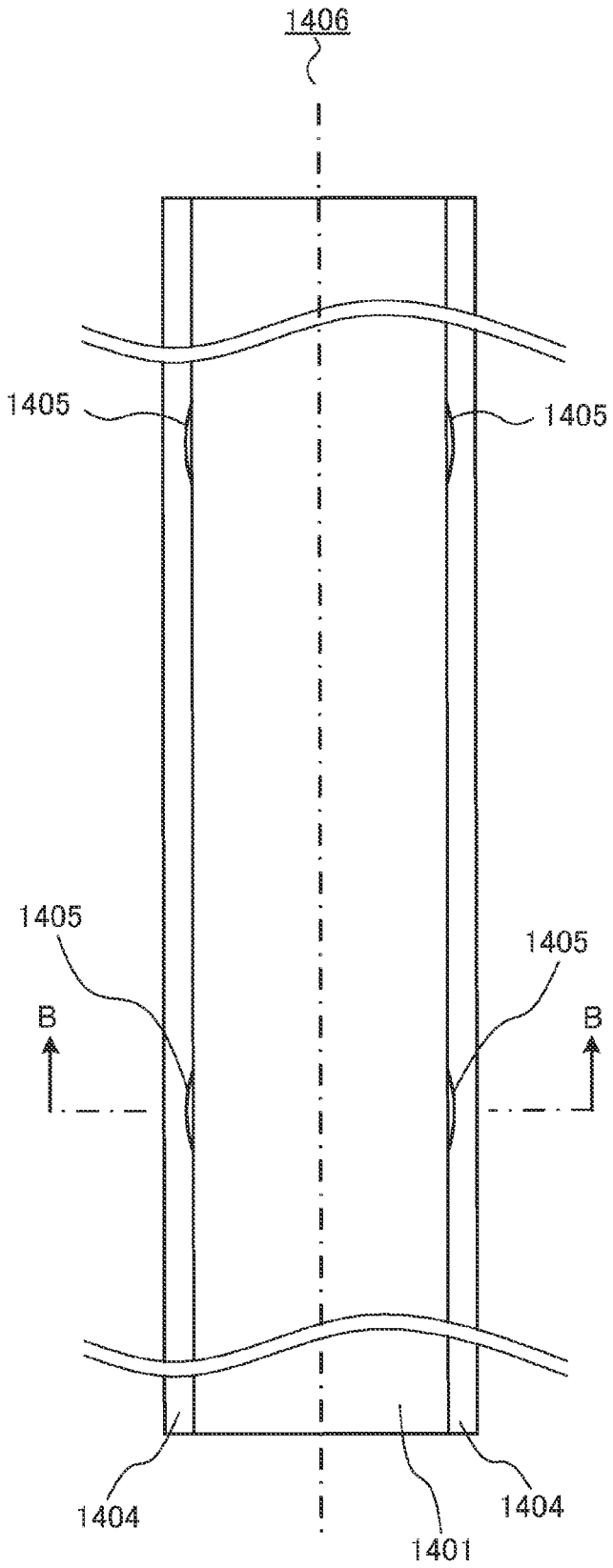
FIG. 16 is a bottom view of a second light flux controlling member in Embodiment 3 of the present invention.
Figure 17:
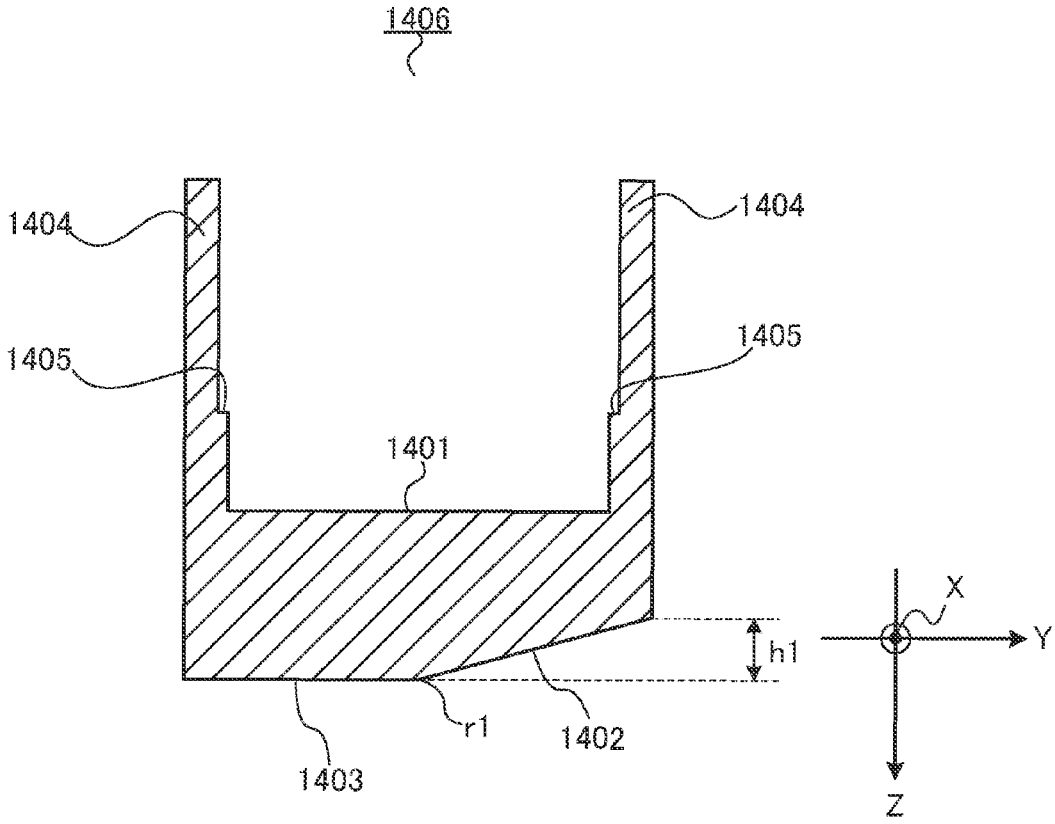
FIG. 17 is a B-B line cross-section of FIG. 16.

FIG. 16 is a bottom view of second light flux controlling member 1406. Also, FIG. 17 is a B-B line cross-sectional view of FIG. 16.

Second light flux controlling member 1406 has second incidence surface 1401 and second emission surface 1402, and is formed to have a plate shape. In the present embodiment, second light flux controlling member 1406 further has third emission surface 1403 connected to second emission surface 1402, leg section 1404 for positioning second light flux controlling member 1406 relative to first light flux controlling member 103, and engagement section 1405 for being engaged with first light flux controlling member 103.

Second incidence surface 1401 is an approximately flat plane perpendicular to the central axis (optical axis P1) and is disposed to oppose at a predetermined distance to first emission surface 114 of first light flux controlling member 103. Second incidence surface 1401 receives incidence of the light emitted from first emission surface 114. Also, second incidence surface 1401 is provided, at both ends thereof, leg sections 1404 that are integrally disposed to extend from second incidence surface 1401 towards the light emitting element 102 side.

In a virtual cross-section S containing the central axis (optical axis P1) in light emitting device 1400 and being perpendicular to illuminated surface 301 when applied to illumination device 1300, second emission surface 1402 is formed to decrease the thickness of second light flux controlling member 1406 gradually. In other words, second emission surface 1402 is formed as an inclined plane that is inclined at a predetermined angle to second incidence surface 1401. Second emission surface 1402 functions as an optical path converting region. Also, second emission surface 1402 is a flat plane in the present embodiment. Further, at a position at which the distance between second incidence surface 1401 and second emission surface 1402 (thickness of second light flux controlling member 1406) attains the maximum, second emission surface 1402 is connected to third emission surface 1403. In other words, second emission surface 1402 is gradually inclined to a position lower by h1 than third emission surface 1403 from the same height as that of third emission surface 1403 in a height direction of second light flux controlling member 1406 (direction parallel to the Z-axis in FIG. 15). Also, second emission surface 1402 functioning as an optical path converting region refracts the light having an optical path on the aforementioned virtual cross-section S and being incident (internal incidence) onto second emission surface 1402 more to the optical axis P1 side than when being incident (internal incidence) onto a plane perpendicular to the optical axis P1.

Third emission surface 1403 is an approximately flat plane parallel to second incidence surface 1401 and perpendicular to the optical axis P1. Also, the boundary line r1 at which second emission surface 1402 and third emission surface 1403 are connected will be a straight line that passes through a predetermined point on the optical axis P1 and is perpendicular to the optical axis P1 and the aforementioned virtual cross-section S. Because second incidence surface 1401 and third emission surface 1403 are formed to be parallel, the exit angle of the light emitted from third emission surface 1403 will be equal to the incidence angle when being incident onto second incidence surface 1401.

A pair of leg sections 1404 are disposed at the two ends of second incidence surface 1401 in the width direction of second light flux controlling member 1406. Also, leg sections 1404 are provided, at an approximately middle position between the two ends in the extending direction, with engagement sections 1405 that are engaged with flange sections 115 of first light flux controlling member 103.

Engagement sections 1405 are grooves that are formed pair by pair at positions that oppose each other in the inside of each of the pair of leg sections 1404. A plurality of pairs of engagement sections 1405 are formed at a predetermined interval in accordance with the pitch of light emitting elements 102 in the illumination device (See FIG. 16). Also, engagement sections 1405 are engaged with flange sections 115 of first light flux controlling member 103, so as to position and fix first light flux controlling member 103. This allows that second incidence surface 1401 opposes first emission surface 114 at a predetermined interval.

Here, in the present embodiment, the construction of the illumination device is the same as that shown in FIG. 4 except that light emitting device 1400 is applied instead of light emitting device 100, so that the description thereof will be omitted. Also, in the present embodiment, the path of light in the illumination device is the same as that shown in FIGS. 8 and 9, so that the description thereof will be omitted.

(Effects of the Present Embodiment)

In this manner, according to the present embodiment, in addition to the above-described effects of Embodiment 1, the second light flux controlling member is used also as a holder for holding and supporting the first light flux controlling member, so that the number of components can be reduced and the production costs can be reduced.

(Modification in the Present Embodiment)

In the present embodiment, the second emission surface is formed as an inclined surface that is inclined at an inclination degree of a predetermined angle relative to the second incidence surface. However, the present invention is not limited to this, so that the second emission surface may be a curved surface that protrudes in a convex shape to the outside where a predetermined thickness difference is provided between the optical axis side and the illuminated surface side in the thickness of the second light flux controlling member.

Embodiment 4

Figure 18A:
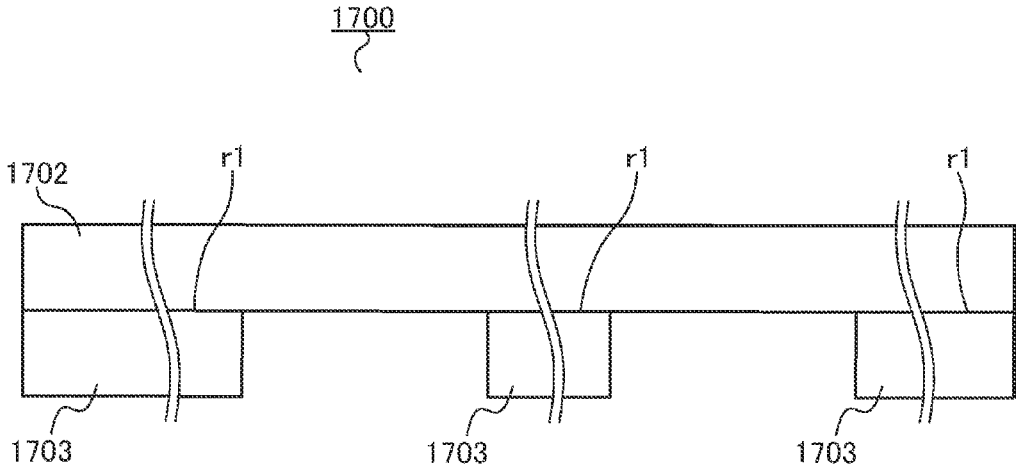
FIG. 18A is a plan view of a second light flux controlling member in Embodiment 4 of the present invention.
Figure 18B:
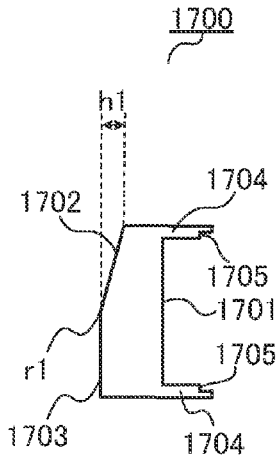
FIG. 18B is a side view of the second light flux controlling member in Embodiment 4 of the present invention.

FIG. 18A is a plan view of second light flux controlling member 1700 in Embodiment 4 of the present invention. Also, FIG. 18B is a side view of second light flux controlling member 1700 in Embodiment 4 of the present invention. Here, the light emitting device according to the present invention has the same construction as that shown in FIG. 2 except that second light flux controlling member 1700 is applied instead of second light flux controlling member 105.

(Construction of Second Light Flux Controlling Member)

Second light flux controlling member 1700 has second incidence surface 1701 and second emission surface 1702, and is formed to have a plate shape. In the present embodiment, second light flux controlling member 1700 further has third emission surfaces 1703 connected to second emission surface 1702.

Second incidence surface 1701 is an approximately flat plane perpendicular to the optical axis P1 and is disposed to oppose at a predetermined distance to first emission surface 114 of first light flux controlling member 103. Second incidence surface 1701 receives incidence of the light emitted from first emission surface 114.

Second emission surface 1702 is disposed on a surface opposite to second incidence surface 1701. Also, in a virtual cross-section S containing the central axis (optical axis P1) when combined with light emitting element 102 and first light flux controlling member 103 to form a light emitting element and being perpendicular to the illuminated surface when applied to illumination device 300, second emission surface 1702 is formed to decrease the thickness of second light flux controlling member 1700 gradually. In other words, second emission surface 1702 is formed as an inclined plane that is inclined at an inclination degree of a predetermined angle to the second incidence surface. Second emission surface 1702 functions as an optical path converting region. Also, second emission surface 1702 is a flat plane in the present embodiment. Further, at a position at which the distance between second incidence surface 1701 and second emission surface 1702 (thickness of second light flux controlling member 1700) attains the maximum, second emission surface 1702 is connected to third emission surfaces 1703. In other words, second emission surface 1702 is gradually inclined to a position lower by h1 than third emission surfaces 1703 from the same height as that of third emission surfaces 1703 in a height direction of second light flux controlling member 1700 (direction parallel to the Z-axis in FIGS. 18A and 18B). Also, second emission surface 1702 functioning as an optical path converting region refracts the light having an optical path on the aforementioned virtual cross-section S and being incident (internal incidence) onto second emission surface 1702 more to the optical axis P1 side than when being incident (internal incidence) onto a plane perpendicular to the optical axis P1.

Third emission surfaces 1703 are approximately flat planes parallel to second incidence surface 1701 and perpendicular to the optical axis P1. Also, the boundary line r1 at which second emission surface 1702 and third emission surfaces 1703 are connected will be a straight line that passes through a predetermined point on the optical axis P1 and is perpendicular to the optical axis P1 and the aforementioned virtual cross-section S. Because second incidence surface 1701 and third emission surfaces 1703 are formed to be parallel, the exit angle of the light emitted from third emission surfaces 1703 will be equal to the incidence angle when being incident onto second incidence surface 1701. Also, third emission surfaces 1703 are formed at both ends in the length direction of second light flux controlling member 1700 and are formed at a predetermined interval (for example, the pitch of light emitting elements 102 in the illumination device) along the length direction of second light flux controlling member 1700.

Here, the construction of the illumination device in the present embodiment is the same as that shown in FIG. 4 except that second light flux controlling member 1700 is applied instead of second light flux controlling member 100, so that the description thereof will be omitted. Also, in the present embodiment, the path of light in the illumination device is the same as that shown in FIGS. 8 and 9, so that the description thereof will be omitted.

(Modification of Second Light Flux Controlling Member)

Figure 19A:
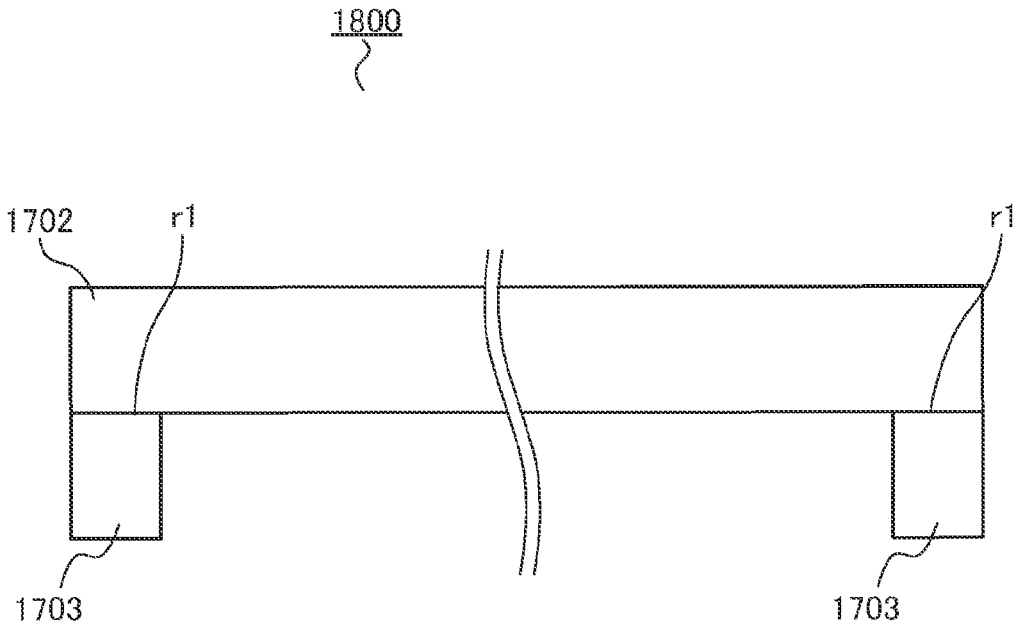
FIG. 19A is a plan view of a modification of the second light flux controlling member in Embodiment 4 of the present invention.
Figure 19B:
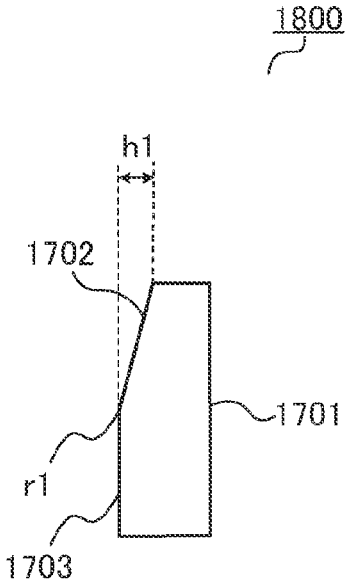
FIG. 19B is a side view of the modification of the second light flux controlling member in Embodiment 4 of the present invention.

FIG. 19A is a plan view of a modification of the second light flux controlling member in the present embodiment. Also, FIG. 19B is a side view of the modification of the second light flux controlling member in the present embodiment. Here, in FIGS. 19A and 19B, the parts having the same construction as those in FIGS. 18A and 18B are denoted with the same reference signs.

Third emission surfaces 1703 are formed at both ends in the length direction of second light flux controlling member 1800. On the other hand, second emission surface 1702 is formed continuously along the length direction of second light flux controlling member 1800. Here, the other constructions are the same as those of FIGS. 18A and 18B, so that the description thereof will be omitted.

In second light flux controlling member 1800, the incidence angle of the light that is incident onto second incidence surface 1701 is equal to the exiting angle of the light that is emitted from third emission surfaces 1703, so that there is no need to dispose third emission surfaces 1703 over the whole of the optical path thereof. Therefore, when third emission surfaces 1703 are formed only at both ends in the length direction of second light flux controlling member 1800 as in the present embodiment, the effects of the present invention can be produced.

(Effects of the Present Embodiment)

In this manner, according to the present embodiment, since the plane part (third emission surfaces 1703 in the present embodiment) is not formed continuously along the length direction of the second light flux controlling member, the material cost in producing the second light flux controlling member can be reduced, so that the production costs can be reduced in addition to the effects of the above-described Embodiment 1.

Also, according to the present embodiment, by forming the third emission surfaces only at both ends in the length direction of the second light flux controlling member, there is no loss of light in passing through the second light flux controlling member, so that the illuminance at the illuminated surface can be improved.

(Modification in the Present Embodiment)

In the present embodiment, the second emission surface is formed to be an inclined surface that is inclined at an inclination of a predetermined angle relative to the second incidence surface. However, the present invention is not limited to this alone, so that the second emission surface may be a curved surface that protrudes to the outside in a convex shape in which a predetermined thickness difference is provided between the optical axis side and the illuminated surface side in the thickness of the second light flux controlling member.

(Modification Common to the Embodiments)

In the above-described Embodiment 1 to Embodiment 4, the boundary line r1 at which the third emission surface and the second emission surface are connected is perpendicular to the optical axis P1; however, the present invention is not limited to this, so that the boundary line r1 may not be perpendicular to the optical axis P1.

Also, in above-described Embodiment 1 to Embodiment 4, the first light flux controlling member is formed to be symmetric relative to the optical axis of the light emitting element. However, the present invention is not limited to this alone, so that the shape of the first light flux controlling member can be an arbitrary shape that can control and emit the light incident onto the first light flux controlling member so that the distribution of the light emitted from the first light flux controlling member will be narrower than the distribution of the light emitted from the light emitting element.

Also, in above-described Embodiment 1 to Embodiment 4, only the second emission surface is formed to be an inclined surface in the second light flux controlling member. However, the present invention is not limited to this alone, so that a region of the second incidence surface on the illuminated surface side may be formed to be an inclined surface in addition to the second emission surface. In other words, the second incidence surface may be formed to be an inclined surface that is inclined at an inclination of a predetermined angle in the virtual cross-section S so that the thickness of the second light flux controlling member is gradually reduced. Also, the aforementioned inclined surface formed in the second incidence surface may be formed to be a curved surface that protrudes to the outside in a convex shape. In this case, the second incidence surface functioning as an optical path converting region refracts the light having an optical path on the aforementioned virtual cross-section S and being incident onto the second incidence surface more to the optical axis P1 side than when the light is incident onto a plane perpendicular to the optical axis P1.

Also, in above-described Embodiment 1 to Embodiment 4, only the second emission surface is formed to be an inclined surface in the second light flux controlling member. However, the present invention is not limited to this alone, so that the second emission surface may be formed to be a plane perpendicular to the optical axis, and a region of the second incidence surface on the illuminated surface side may be formed to be an inclined surface. In other words, an optical path converting region such that the thickness of the second light flux controlling member is gradually reduced according as it approaches the illuminated surface may be formed by forming an inclined surface that is inclined at an inclination of a predetermined angle or a curved surface that protrudes to the outside in a convex shape in the virtual cross-section S in at least one of the incidence surface and the emission surface of the second light flux controlling member. In this case, the second incidence surface functioning as an optical path converting region refracts the light having an optical path on the aforementioned virtual cross-section S and being incident onto the second incidence surface more to the optical axis P1 side than when the light is incident onto a plane perpendicular to the optical axis P1.

INDUSTRIAL APPLICABILITY

The light emitting device and the illumination device according to the present invention are suitable particularly in controlling the distribution of a light emitted from a light source to illuminate a surface to be illuminated.

REFERENCE SIGNS LIST

100 Light emitting device
101 Substrate
102 Light emitting element
103 First light flux controlling member
104 Holder
105 Second light flux controlling member
110 First incidence surface
110*a* Inner ceiling surface
110*b* Inner wall surface
111 Concave part
113 Total reflection surface
114 First emission surface
115 Flange section
116 Bottom surface
117 Outer circumferential section
118 Apex
201 Second incidence surface
202 Second emission surface
203 Third emission surface
204 Leg section
205 Engagement section

The invention claimed is:

1. An illumination device comprising:

a light emitting device; and a planar illuminated surface adjacent to a cavity to be illuminated by the light emitting device, wherein the light emitting device comprising:

a light source;

a first light flux controlling member for controlling the distribution of light emitted from the light source; and a second light flux controlling member for controlling the distribution of the light emitted from the first light flux controlling member, wherein the illuminated surface is disposed in parallel to an optical axis of the light source, wherein the first light flux controlling member has a first incidence surface onto which the light emitted from the light source is incident and a first emission surface that is located on a side opposite to the first incidence surface and emits the light incident on the first incidence surface, wherein the second light flux controlling member has a second incidence surface onto which the light emitted from the first light flux controlling member is incident, a second emission surface that is located on a side opposite to the second incidence surface and emits the light incident on the second incidence surface, and a third emission surface that is located on a side opposite to the second incidence surface and emits the light incident on the second incidence surface, wherein the second emission surface is disposed closer to the illuminated surface than the third emission surface, wherein a boundary line between the second emission surface and the third emission surface is perpendicular to a virtual cross-section which includes the optical axis of the light source and is perpendicular to the illuminated surface, and wherein the distance between the second incidence surface and the second emission surface is gradually reduced away from the boundary line.

2. The illumination device according to claim 1, comprising a plurality of the light sources arranged at a predetermined interval in a direction perpendicular to the virtual cross-section, a plurality of the first light flux controlling members disposed in one-to-one correspondence to the light sources, and the second light flux controlling member.

3. The illumination device according to claim 1, wherein the second light flux controlling member is a holder that holds and supports the first light flux controlling member.

4. The illumination device according to claim 1, further comprising an opposing illuminated surface that is disposed to be parallel to the illuminated surface in opposition to the illuminated surface with the optical axis intervening therebetween.

5. The illumination device according to claim 4, wherein the opposing illuminated surface is a reflection plane.

6. The illumination device according to claim 4, wherein the second light flux controlling member is disposed between the illuminated surface and the opposing illuminated surface and is held and supported by at least one of the illuminated surface and the opposing illuminated surface.

7. The illumination device according to claim 1, wherein the third emission surface is parallel to the second incidence surface.

* * * * *